US005145027A

United States Patent [19]

Petzl et al.

[11] Patent Number: 5,145,027

[45] Date of Patent: Sep. 8, 1992

[54] ROPING SIT HARNESS FOR CLIMBING OR CAVING

[75] Inventors: Paul Petzl, Barraux; Pierre Petzl, Saint-Nazaire les Eymes, both of France

[73] Assignee: Petzl S.A., Crolles, France

[21] Appl. No.: 794,259

[22] Filed: Nov. 19, 1991

[30] Foreign Application Priority Data

Dec. 4, 1990 [FR] France ..... 90 15272

[51] Int. Cl.[5] ..... A26B 1/16; A62B 35/00

[52] U.S. Cl. ..... 182/3; 119/96; 244/151 R; 182/6

[58] Field of Search ..... 244/151 R, 151 A, 151 B, 244/152; 182/3-9; 119/96, 101

[56] References Cited

U.S. PATENT DOCUMENTS 3,829,045 8/1974 Snyder ..... 244/152
4,378,921 4/1983 Allen et al. .
4,410,175 10/1983 Shamp ..... 244/151 R
4,446,943 5/1984 Murray ..... 182/6
4,687,074 8/1987 Green ..... 182/3

FOREIGN PATENT DOCUMENTS 2221910 10/1974 France .
272602 6/1927 United Kingdom .
519075 3/1940 United Kingdom ..... 244/151 R

*Primary Examiner*—Galen Barefoot
*Attorney, Agent, or Firm*—Stevens, Davis Miller & Mosher

[57] ABSTRACT

A sit safety harness comprises a pair of thigh loops in the form of closed loops and a belt with a central clasping device. Adjustment of the size of each thigh loop is performed by means of a clamping buckle fixed to the belt by an attachment strap and an adjustment strap securedly affixed by its end to the loop. The latter remains closed permanently throughout adjustment.

4 Claims, 4 Drawing Sheets

ROPING SIT HARNESS FOR CLIMBING OR CAVING

BACKGROUND OF THE INVENTION

The invention relates to a roping sit harness for the safety of persons abseiling along a rope, comprising a pair of thigh loops associated with a belt equipped with a central clasping device arranged on the ventral branch, each thigh loop being equipped with an extending end attached to a first and a second joining points of the ventral branch, and an adjustment device designed to adjust the required size of the thigh loop according to the morphology of the user.

Adjustment of the thigh loops equipping state-of-the-art sit harnesses or body harnesses is generally performed by means of a buckle attached to each thigh loop. Formation of the latter results from the free end of the main strap being passed through the buckle. The strap merely has to be pulled in one direction or the other at the level of the buckle to obtain the required size. Such an arrangement requires efficient locking of the rope in the buckle. Following a fall, a locking failure is indeed liable to result in an undesirable release of the strap from the buckle, and simultaneous opening of the thigh loop. The presence of the buckle on the thigh loop also gives rise to the problem of detachment of the buckle when the sit harness is used.

The object of the invention consists in improving the safety and comfort of adjustable roping sit harnesses or body harnesses.

SUMMARY OF THE INVENTION

The sit harness according to the invention is characterized in that the adjustment device of each thigh loop comprises a clamping buckle fixed to the belt by an attachment strap, and an adjustment strap having a first free end cooperating with the buckle, and a second opposite end securedly affixed to the closed loop of the thigh loop, and that the fixing means, forming said closed loop, is situated between the clamping buckle and the second end when the adjustment strap is engaged in the buckle.

The first safety criterion is achieved by the impossibility of opening the thigh loops. It is sure that the loops of the thigh loops are permanently closed, regardless of the state of the adjustment device.

The second safety criterion results from the adjustment buckle being fixed to the belt, and not to the thigh loop. The detachment effect of the buckle is thus avoided.

The adjustment strap passes through a retaining strip fixed to each thigh loop at the level of the corresponding fixing means.

The width of the adjustment strap and corresponding attachment strap is smaller than that of the strap forming the thigh loops.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
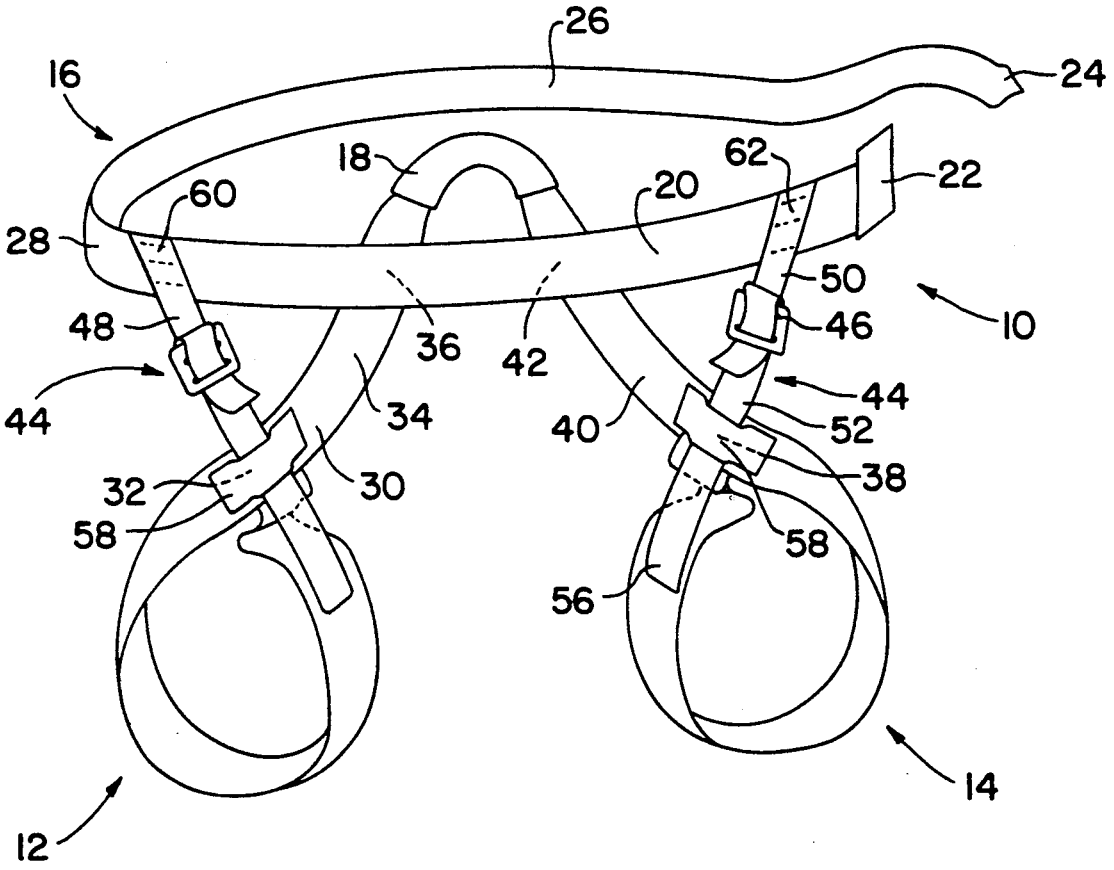
FIG. 1 is a schematic view of a sit harness equipped with the adjustment device according to the invention.

In the figures, a safety sit harness 10 or body harness comprises a pair of thigh loops 12, 14, and a belt 16 equipped with a central clasping device 18 arranged on the ventral branch 20. The end of the ventral branch 20 is provided with an attachment 22 or catch designed to receive the other end 24 of the dorsal branch 26 to adjust the circumference of the belt 16 to the size of the user's waist. The belt 16 is made up from a first strap 28 made of flexible material with a high mechanical resistance, notably polyamide.

A second strap 30 of the same kind as the first 28 is used for arranging identical thigh loops 12, 14, joined together by the clasping device 18.

One of the ends of the second strap 30 is attached by a first fixing means 32 at a first predetermined point of said strap 30 to form the first thigh loop 12 in the form of a closed loop. An extending end 34 of the first thigh loop 12 is fixed to a first joining point 36 of the ventral branch 20.

The second thigh loop 14 is achieved in the same way by means of a second fixing means 38 designed to assemble the opposite end of the strap 30 at a second point. Positioning of the two fixing points of the thigh loops 12, 14 is chosen so as to obtain two identical loops. The extending end 40 of the second thigh loop 14 is attached to a second joining point 42 of the belt 16.

The clasping device 18 is formed by a loop of the strap 30 joined to the two joining points 36, 42. Any other clasping system can be used, notably a metal buckle or two separate attachments.

Each thigh loop 12, 14 is equipped with an adjustment device 44 designed to adjust the size of the loop according to the morphology of the user.

According to the invention, the adjustment device 44 of each thigh loop 12, 14 comprises a clamping buckle 46 fixed to the ventral branch 20 of the belt 16 by an attachment strap 48, 50 and an adjustment strap 52 one of the ends 54 of which cooperates with the buckle 46, and the other end 56 of which is securedly affixed to the closed loop of the thigh loop 12, 14. A retaining strip 58 is sewn onto the visible face of each thigh loop 12, 14 near the fixing means 32, 38 for the adjustment strap 52 to pass through.

The two clamping buckles 46 represented in the figures are of the multiple passage type of the adjustment strap 52, but other buckles, notably self-tightening, can be used.

The distance between the joining points 36, 42 of the extending ends 34, 40 is smaller than the distance between the stitched seams 60, 62 joining the attachment straps 48, 50 to the belt 16.

Figure 2:
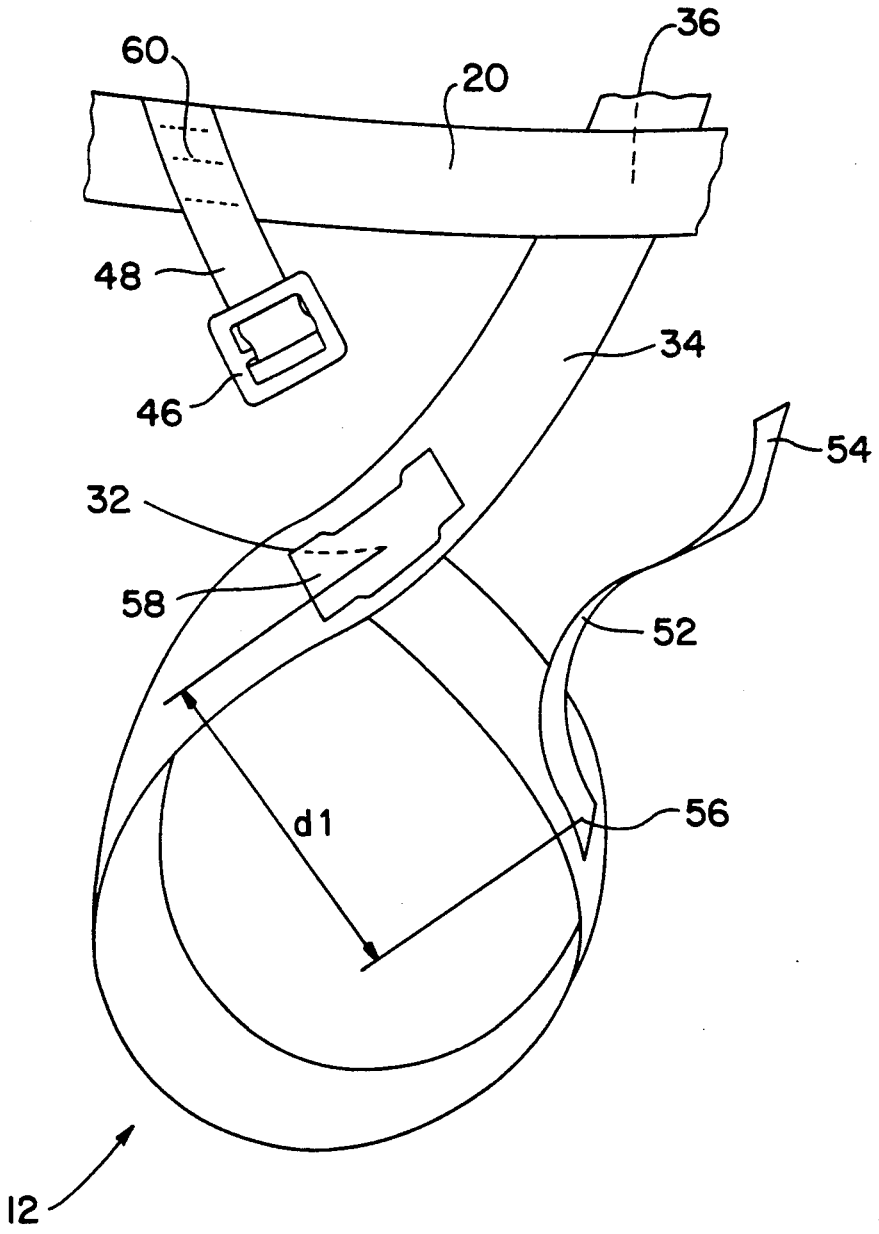
FIGS. 2 to 4 show a partial enlarged scale view of FIG. 1, of different stages of implementing adjustment of a thigh loop.
Figure 3:
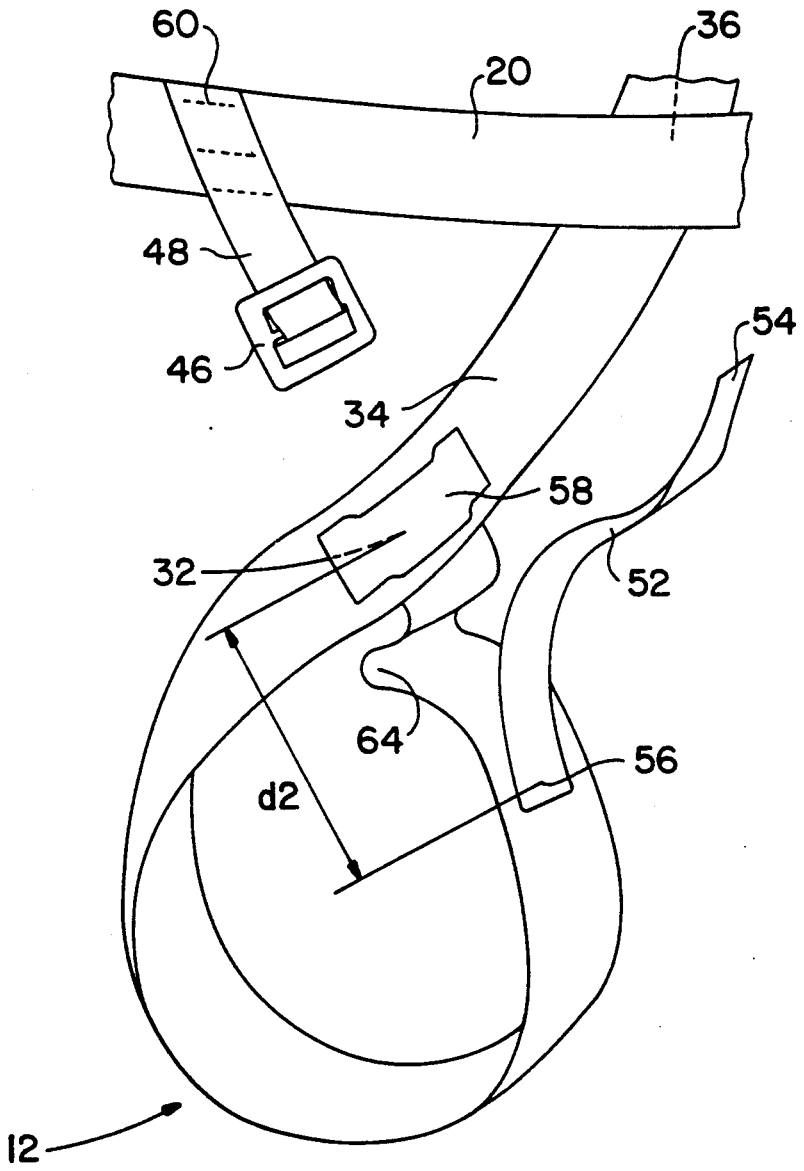
Figure 4:
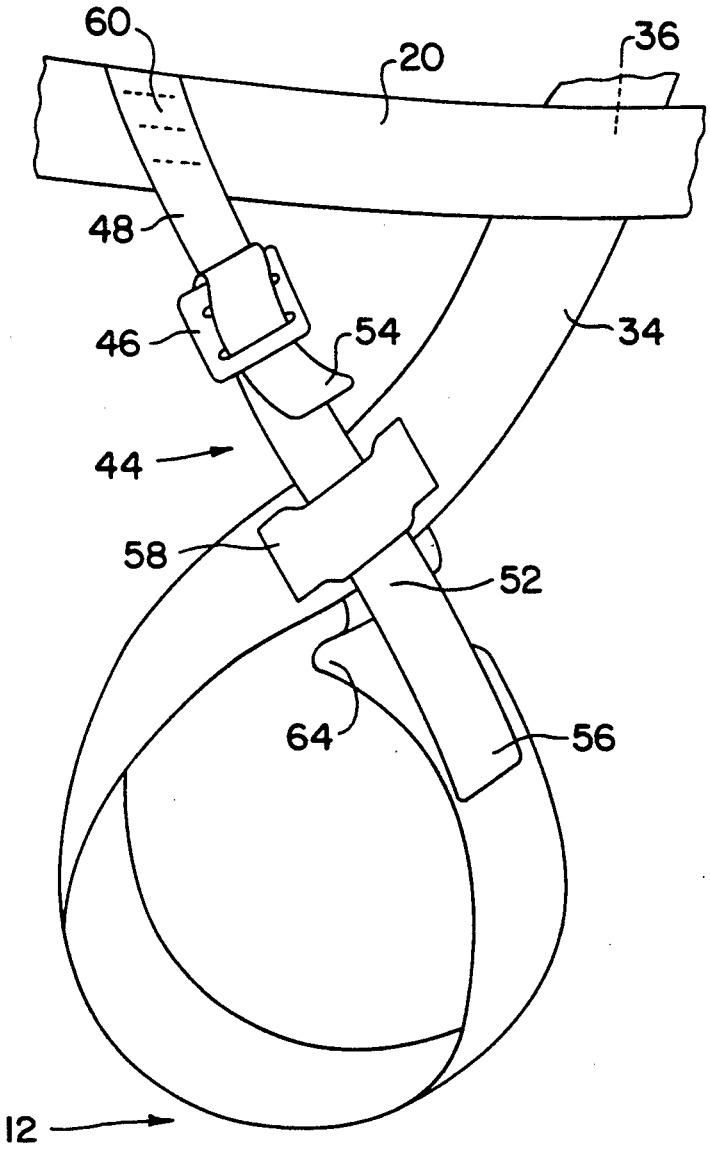

Operation of the adjustment device 44 of one 12 of the thigh loops is illustrated in FIGS. 2 to 4:

In FIG. 2, the adjustment strap 52 is not engaged in the retaining strip 58 and in the clamping buckle 46, and the distance d1 between the attachment end 56 and the first fixing means 32 is maximum. The thigh loop 12 is permanently closed and the loop presents its largest size.

To reduce the size of the loop to suit the morphology of the user, a traction merely has to be exerted on the adjustment strap 52 so as to pull the end 56 towards the first fixing means 32 and reduce the distance d2 with respect to d1 (FIG. 3).

Formation of an inward fold 64 enables a reduction of the size of the loop to be achieved.

In FIG. 4, the adjustment strap 52 passes through the retaining strip 58 and is engaged in the buckle 46 to adjust the size of the thigh loop 12 to a predetermined value.

The same operation is performed on the other thigh loop 14.

It can be noted that the thigh loops 12, 14 remain permanently closed regardless of the state of the adjustment device 44. The sit harness 10 is therefore particularly well suited for climbing schools as it can always be used with sufficient safety, even if the user forgets to engage the adjustment strap 52 in the clamping buckle 46.

The width of the adjustment strap 52 and attachment strap 48, 50 is smaller than that of the second strap 30. This results in the clamping buckle 46 also having a smaller width than that of the strap 30.

Fixing of the clamping buckle 46 to the belt 16, and not to the thigh loop 12, or 14, prevents any detachment effect of the buckle 46 when the sit harness 10 is used.

We claim:

1. A roping sit harness for the safety of persons abseiling along a rope, the sit harness being made up from a strap of flexible material with a high mechanical resistance, and comprising:

a pair of thigh loops, each thigh loop being in the form of a loop closed by a fixing means, a belt having a first ventral branch, and a second dorsal branch, a central clasping device arranged in the middle part of the first ventral branch, a pair of extending ends joining the thigh loops to a first and a second joining points of the first branch, on each side of the clasping device, an adjustment device associated with each thigh loop to adjust the size according to the morphology of the user, a pair of clamping buckles fixed to the first branch of the belt by two attachment straps, an adjustment strap of said adjustment device of each thigh loop having a first free end cooperating with the clamping buckle of the corresponding attachment strap, and a second opposite end securedly affixed to the closed loop of the thigh loop, said fixing means of each thigh loop being located between the clamping buckle and the second end when the adjustment strap is engaged in the buckle.

2. The harness according to claim 1, wherein the adjustment strap passes through a retaining strip fixed to each thigh loop at the level of the corresponding fixing means.

3. The harness according to claim 1, wherein the distance between the first and second joining points of the extending ends of the belt is smaller than that arranged between the fixing seams of the attachment straps.

4. The harness according to claim 3, wherein the width of the adjustment strap and corresponding attachment strap is smaller than that of the strap forming the thigh loops.

* * * * *